US006441797B1

(12) United States Patent
Shah

(10) Patent No.: US 6,441,797 B1
(45) Date of Patent: Aug. 27, 2002

(54) AGGREGATED DISTRIBUTION OF MULTIPLE SATELLITE TRANSPONDER SIGNALS FROM A SATELLITE DISH ANTENNA

(75) Inventor: Dipak M. Shah, Westminster, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/675,526

(22) Filed: Sep. 29, 2000

(51) Int. Cl.[7] ..... H01Q 19/12
(52) U.S. Cl. ..... 343/840; 343/781 R; 455/3.04
(58) Field of Search ..... 343/840, 850, 343/786, 876, 912, 781 R; 455/3.02, 3.04, 277.1, 280, 293, 428; 348/20

(56) References Cited

U.S. PATENT DOCUMENTS 5,212,553 A 5/1993 Maruoka ..... 358/188
5,448,254 A 9/1995 Schneeman et al. .... 343/781 R
5,448,255 A * 9/1995 Hulett et al. ..... 343/840
5,483,663 A * 1/1996 Tawil ..... 455/3.02
5,600,336 A 2/1997 Kubo et al. ..... 343/756
5,825,333 A 10/1998 Kudoh et al. ..... 343/781 R
5,959,592 A 9/1999 Petruzzelli ..... 343/840
5,999,138 A * 12/1999 Ponce De Leon ..... 343/745
6,166,704 A * 12/2000 Jan et al. ..... 343/840
6,222,495 B1 * 4/2001 Cook et al. ..... 343/840

* cited by examiner

*Primary Examiner*—Tan Ho
(74) *Attorney, Agent, or Firm*—John A. Crook; Michael W. Sales

(57) ABSTRACT

An Out Door Unit (ODU) provides the capability to aggregate signals received from more than one satellite before providing the signals to a multi-switch for selection 0by an integrated decoder-receiver (IRD). The signals from a first satellite are relocated by means of a local oscillator and multiplier to frequencies of unused channels in the signals from a second satellite. The relocated signals from the first satellite are then summed with the unused channels in the signals from the second satellite.

12 Claims, 4 Drawing Sheets

AGGREGATED DISTRIBUTION OF MULTIPLE SATELLITE TRANSPONDER SIGNALS FROM A SATELLITE DISH ANTENNA

CROSS-REFERENCE TO RELATED APPLICATION

This application is related to co-pending and commonly-assigned application Ser. No. 09/676,065 filed on same date herewith, by Kesse C. Ho, and entitled "LOW NOISE BLOCK DOWN CONVERTER ADAPTER WITH BUILT-IN MULTI-SWITCH FOR A SATELLITE DISH ANTENNA," which application is incorporated by reference herein.

BACKGROUND OF THE INVENTION

1. Field of the Invention.

The present invention relates generally to a satellite receiver antenna, and in particular, to the aggregated distribution of multiple satellite transponder signals in a satellite dish antenna.

2. Description of the Related Art.

DIRECTV® can broadcast video programming signals from transponders on three satellites in three different orbital slots located at 101 West Longitude (WL), 119 WL, and 110 WL, also known as Sat A, Sat B, and Sat C, respectively. The FCC (Federal Communications Commission) has allocated to DIRECTV® transponders 1–32 on 101 WL, transponders 22–32 on 119 WL, and transponders 28, 30, 32 on 110 WL.

In the prior art, a four-input multi-switch (Multi-SW) was used to select among the signals received from the transponders on 101 WL and 119 WL, wherein there are two different signal polarizations (Left and Right) output by each associated low noise block down converters with feed (LNBFs) for each orbital slot and each of the different signal polarizations is a separate input to the multi-switch. However, to accommodate the additional orbital slot located at 110 WL would require a greater number of inputs on the multi-switch.

In a conventional signal acquisition and distribution method, five cables would be used to receive signals from the transponders in the three orbital slots using three associated LNBFs, wherein two of the LNBFs have dual outputs to the multi-switch (one for each of the two signal polarizations for 101 WL and 119 WL) and one of the LNBFs has a single output to the multi-switch (one for the single signal polarization for 110 WL). Further, a conventional signal acquisition and distribution method would require the use of an addressing-capable multi-switch and an integrated receiver-decoder (IRD) capable of providing a compatible addressing signal to the multi-switch to select and decode the five different inputs. This adds a level of complexity to these two devices, increases their manufacturing and installation costs, and lowers system reliability.

Thus, there is a need in the art for a method wherein signals from multiple satellites can be received and distributed using fewer sets of cables. There is also a need for a method that simplifies polarization switching requirements for the LNBFs and IRD.

SUMMARY OF THE INVENTION

The present invention describes an antenna or Out Door Unit (ODU) that provides the capability to aggregate signals received from more than one satellite before providing the signals to a multi-switch for selection by an integrated decoder-receiver (IRD). The signals from a first satellite are relocated by means of a local oscillator and multiplier to frequencies of unused channels in the signals from a second satellite. The relocated signals from the first satellite are then summed with the unused channels in the signals from the second satellite.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which show, by way of illustration, several embodiments of the present invention. It is understood that other embodiments may be utilized and structural changes may be made without departing from the scope of the present invention.

Figure 1:
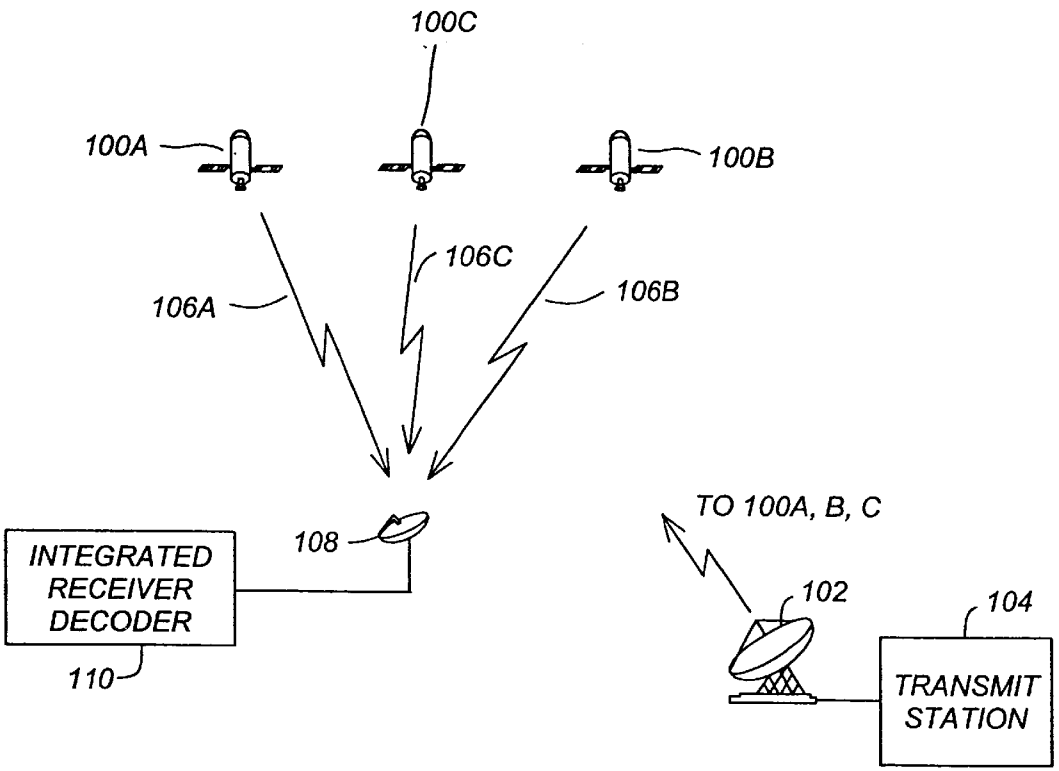
FIG. 1 is a diagram illustrating an overview of a multiple satellite video distribution system according to the preferred embodiment of the present invention.

FIG. 1 is a diagram illustrating an overview of a multiple satellite video distribution system according to the preferred embodiment of the present invention. The system includes multiple satellites 100A–C, uplink antenna 102, and transmit station 104. In the preferred embodiment, the three satellites 100A–C are in three different orbital slots located at 101 West Longitude (WL) 100A, 119 WL 100B, and 110 WL 100C, wherein the video programming signals 106A–C are transmitted from transponders 1–32 on 101 WL 100A, transponders 22–32 on 119 WL 100B, and transponders 28, 30, and 32 on 110 WL 100C. The radio frequency (RF) signals 106A–C are received at one or more downlink antennae 108, which in the preferred embodiment comprise subscriber receiving station antennae 108, also known as outdoor units (ODUs). Each downlink antennae 108 is coupled to one or more integrated receiver-decoders (IRDs) 110 for the reception and decoding of video programming signals 106A–C.

Figure 2:
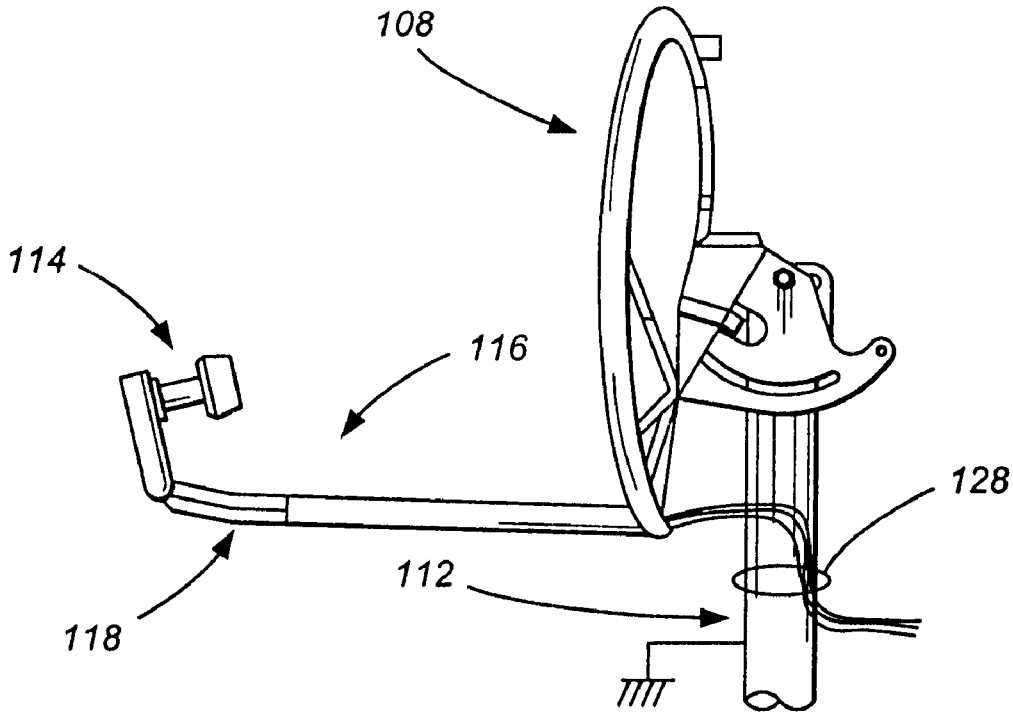
FIG. 2 illustrates an antenna configured according to the preferred embodiment of the present invention.

FIG. 2 illustrates the subscriber antenna 108 as configured according to the preferred embodiment of the present invention. In the side view of FIG. 2, the antenna 108 has an 18"×24" oval-shaped Ku-band reflecting surface that is supported by a mast 112, wherein a minor axis (top to bottom) of the reflecting surface is narrower than its major axis (left to right). The antenna 108 curvature is due to the offset of one or more low noise block down converters with feed (LNBFs) 114, which are used to receive signals reflected from the antenna 108. In the preferred embodiment, a support bracket 116 positions an LNBF/Multi-SW Adapter 118 and multiple LNBFs 114 below the front and center of the antenna 108, so that the LNBFs 114 do not block the incoming signals 106A–C. Moreover, the support bracket 116 sets the focal distance-between the antenna 108 and the LNBFs 114.

The LNBFs 114 comprise a first stage of electronic amplification for the subscriber receiving station. Each LNBF 114 down converts the 12.2–12.7 GHz signals 106A–C received from the satellites 100A–C to 950–1450 MHz signals required by a tuner/demodulator of the IRD 110. The shape and curvature of the antenna 108 allows the antenna 108 to simultaneously direct energy into two or three proximately disposed LNBFs 114.

In one embodiment, the orbital locations of the satellites 100A–C are chosen so that the signals 106A–C received from each satellite 100A–C can be distinguished by the antenna 108, but close enough so that signals 106A–C can be received without physically slewing the axis of the antenna 108. When the user selects program material broadcast by the satellites 100A–C, the IRD 110 electrically switches LNBFs 114 to receive the broadcast signals 106A–C from the satellites 100A–C. This electrical switching occurs using a combiner and multi-switch within the LNBF/Multi-SW Adapter 118.

Figure 3:
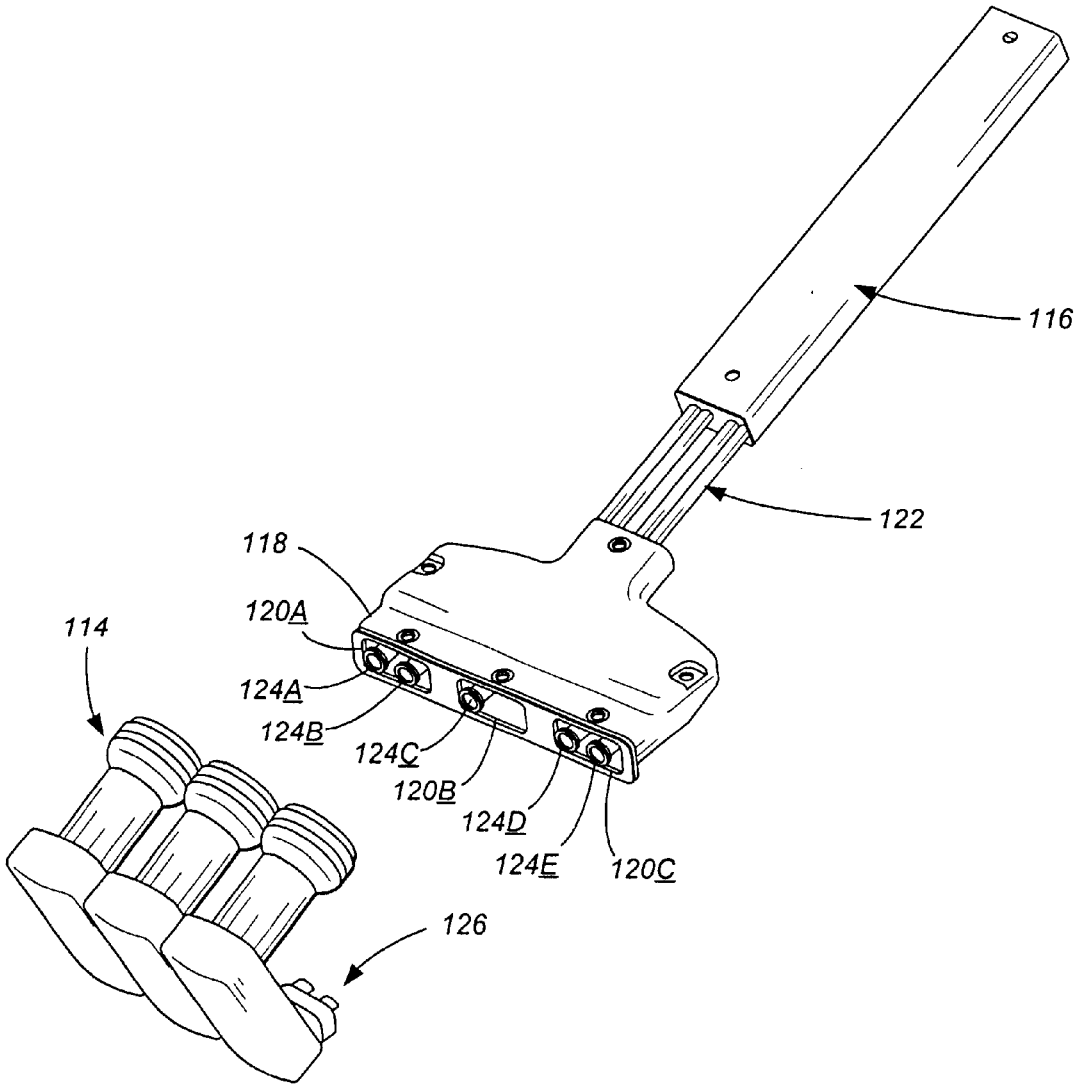
FIG. 3 illustrates the structure of an LNBF/Multi-SW Adapter according to the preferred embodiment of the present invention.

FIG. 3 is an exploded view that illustrates the structure of the LNBF/Multi-SW Adapter 118 according to the preferred embodiment of the present invention. The LNBF/Multi-SW Adapter 118 is described in detail in co-pending and commonly-assigned application Ser. No. 09/676,065, filed on same date herewith, by Kesse C. Ho, and entitled "LOW NOISE BLOCK DOWN CONVERTER ADAPTER WITH BUILT-IN MULTI-SWITCH FOR A SATELLITE DISH ANTENNA," which application is incorporated by reference herein.

The LNBF/Multi-SW Adapter 118 is a single plastic Y-shaped housing that incorporates a combiner and multi-switch (shown in FIG. 4), three ports 120A–B for connection to three LNBFs 114, and four outputs that comprise four cables 122 that exit from the rear of the Adapter 118 for connection to the IRDs 110.

Two of the three ports 120A and 120C have two male 'F' connectors 124A, B, D, and E, and one of the three ports 120B has a single male 'F' connector 124C. A dual output LNBF 114 is inserted into each of ports 120A and 120C (for 101 WL 100A and 119 WL 100B, respectively), while a single output LNBF 114 is inserted into port 120B (for 110 WL 100C). The female 'F' connectors 126 comprising output IF (intermediate frequency) terminals of each LNBF 114 simply plug into the male 'F' connectors 124 of the Adapter 118. Of course, those skilled in the art will recognize that other embodiments could have different numbers of ports 120, different configurations of connectors 124 and 126, and support various types and numbers of LNBFs 114.

The Adapter 118 mates to the support bracket 116, although the Adapter 118 is shown separated from the support bracket 116 in FIG. 3 for the purposes of illustration. In this embodiment, the support bracket 116 comprises a hollow tube that carries the cables 122 to the rear of the antenna 108 for connection to the IRDs 110. Only the coaxial cables 122 that connect to the IRD 110 exit from the support bracket 116 at the rear of the antenna 108.

Figure 4:
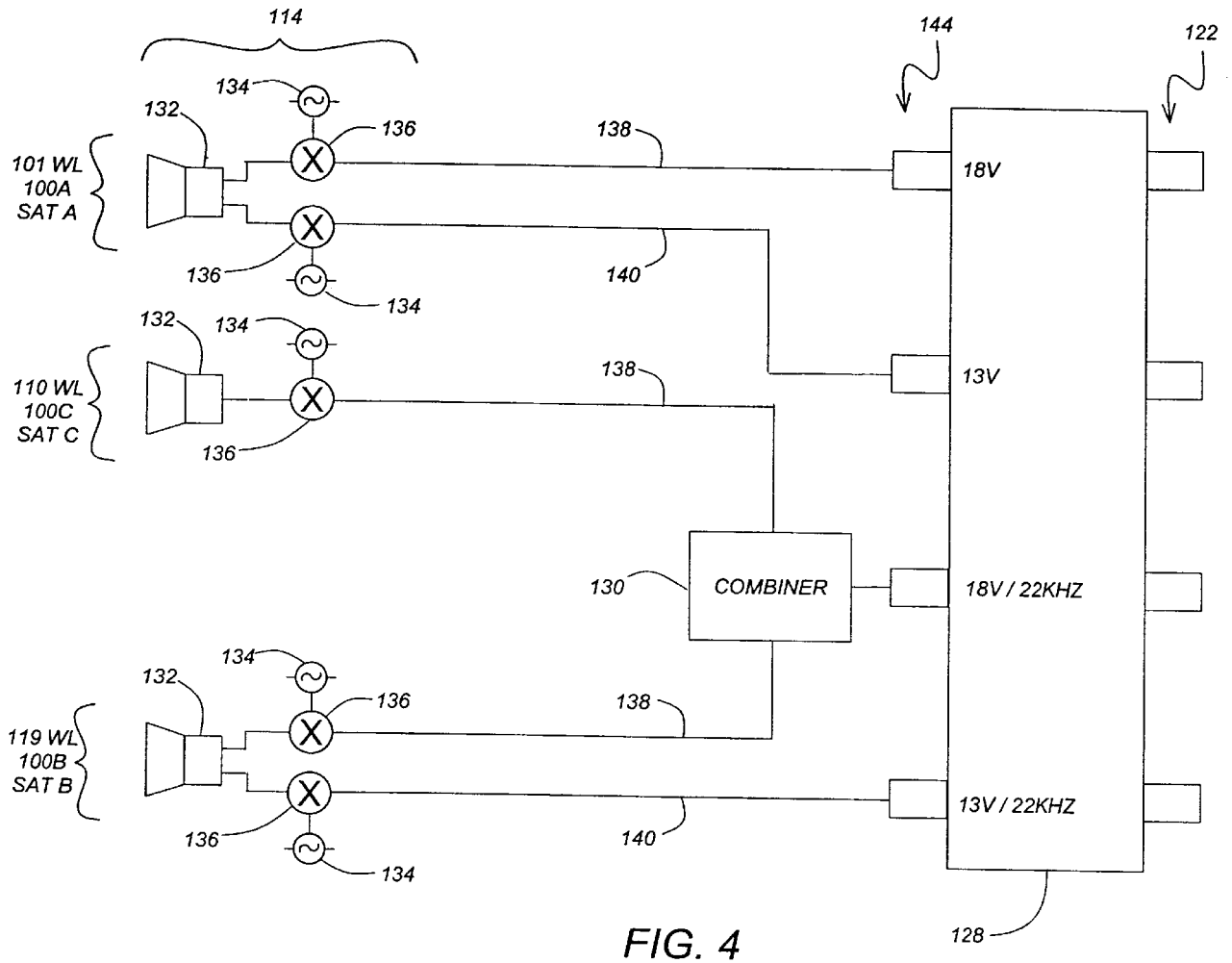
FIG. 4 illustrates the operation of a multi-switch and combiner according to the preferred embodiment of the present invention.

FIG. 4 illustrates the operation of a multi-switch 128 and combiner 130 according to the preferred embodiment of the present invention. In the preferred embodiment, the multi-switch 128 and combiner 130 are housed within the Adapter 118, although other embodiments could mount these components in any location.

The 12.2~12.7 GHz signals 106A–C received from the satellites 100A–C pass through a feed horn 132 of the LNBF 114 and are down converted by a local oscillator 134 and multiplier 136 in the LNBF 114 to the 950–1450 MHz signals required by a tuner/demodulator of the IRDs 110. Left and right polarized signals 138 and 140 are output from the LNBFs 114.

The local oscillator 134 and multiplier 136 in the LNBF 114 for 110 WL 100C are used to relocate the channels for 110 WL 100C for the purposes of the present invention. Specifically, the local oscillator 134 and multiplier 136 in the LNBF 114 for 110 WL 100C relocate the three channels received from 110 WL 100C into unused positions within the assigned 950~1450 MHz spectrum of 119 WL 100B (in one example, channels 28, 30, and 32 are relocated to channels 8, 10, and 12). The combiner 130 then masks the unused 119 WL 100B channels and combines the relocated 110 WL 100C channels with the assigned 950~1450 MHz spectrum of 119 WL 100B. Specifically, the combiner 130 sums the relocated channels from 110 WL 100C with the channels received from 119 WL 100B (in one example, relocated channels 8, 10, and 12 from 110 WL 100C are summed with channels 22–32 from 119 WL 100B) within the assigned 950–1450 MHz spectrum.

Those skilled in the art will note that the channel assignments provided above are merely illustrative, and that any desired channel arrangement could be used by proper selection of the local oscillator 134 frequency. Moreover, those skilled in the art will recognize that channels from more than two signal polarizations could be relocated and aggregated using the present invention, with the use of additional or different combiners 130, oscillators 134, and multipliers 136.

This summed output from the combiner 130 is then provided to single input 144 of the multi-switch 128. The multi-switch 128 generally comprises a cross-bar switch, wherein any of the four cables 122 can be connected to any of the four inputs 144 from the three LNBFs 114. The selection of which input 144 to connect to a desired cable 122 via the multi-switch 128 is controlled by a signal received on the coaxial cable 122 from the IRD 110, in a manner well known in the art (e.g., an 18V, 13V, 18V/22 kHz, or 13V /22 kHz signal from the IRD 110 selects one of the four inputs 144 to the multi-switch 128).

Thus, the present invention provides the capability to aggregate the signals 106B and 106C received from satellites 119 WL 100B and 110 WL 100C before the multi-switch 128, in order to decrease the number of inputs needed on the multi-switch 128. Consequently, a four-input multi-switch 128 can be used to select among five different signals output from three different LNBFs 114 based on three different sets of signals 106A-C received from transponders on three different satellites 100A–C. Moreover, fewer sets of cables 122 are required and the polarization switching requirements for the LNBFs 114, multi-switch 128, and IRDs 110 are simplified, thereby resulting in significant savings in component and installation costs.

This concludes the description of the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching.

It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus for combining a first signal having a first set of channels received from a first satellite and a second signal having a second set of channels received from a second satellite, comprising:

a combiner for summing the first set of channels into the second set of channels, wherein the first set of channels have been relocated to frequencies of one or more unused channels within the second set of channels; and a multi-switch for accepting the summed first and second set of channels at a one of a plurality of inputs thereof, wherein the multi-switch includes a plurality of outputs and connects a selected one of the inputs to a selected one of the outputs.

2. The apparatus of claim 1, wherein the first and the second set of channels are received from a plurality of transponders on a plurality of satellites in a plurality of orbital slots.

3. The apparatus of claim 2, wherein the first and second set of channels are output from different low noise block down converters with feed (LNBFs) into the combiner.

4. The apparatus of claim 1, wherein the combiner further comprises means for masking the unused channels in the second set of channels and for summing the relocated first set of channels into the second set of received signals using the masked, unused channels in the second set of channels.

5. An antenna unit for receiving signals transmitted from a plurality of communications satellites, for converting the received signals, and for outputting the converted signals to a receiver, comprising:

a reflecting surface;

a plurality of low noise block down converters with feed (LNBFs), wherein each of the LNBFs includes an oscillator and a multiplier for converting the signals received from the satellites to a specified frequency spectrum;

a combiner for summing the converted signals from a first one of the LNBFs with the converted signals from a second one of the LNBFs, wherein the signals from the first one of the LNBFs have been relocated to frequencies of one or more unused channels within the signals from the second one of the LNBFs; and a multi-switch, having a plurality of inputs and outputs, for accepting the summed signals from the first and second ones of the LNBFs at one of the inputs thereof, wherein the multi-switch connects a selected one of the inputs to a selected one of the outputs.

6. The antenna unit of claim 5, wherein signals from the first and second ones of the LNBFs are received from different transponders on different satellites in different orbital slots.

7. The antenna unit of claim 5, wherein the combiner further comprises means for masking the unused channels in the signals from the second one of the LNBFs and summing the relocated signals from the first one of the LNBFs into the signals from the second one of the LNBFs using the masked, unused channels.

8. The antenna unit of claim 5, wherein the outputs each comprise a coaxial cable for connection to an integrated receiver-decoder (IRD).

9. A method for combining a signal having a first set of channels received from a first satellite and a second signal having a second set of channels received from a second satellite, comprising:

summing the first set of channels into the second set of channels, wherein the first set of channels have been relocated to frequencies of one or more unused channels within the second set of channels; and accepting the summed first and second set of channels at one of a plurality of inputs to a multi-switch, wherein the multi-switch includes a plurality of outputs and connects a selected one of the inputs to a selected one of the outputs.

10. The method of claim 9, wherein the first and the second set of channels are received from a plurality of transponders on a plurality of satellites in a plurality of orbital slots.

11. The method of claim 9, wherein the first and the second set of channels are output from a plurality of low noise block converters with feed (LNBFs).

12. The method of claim 9, wherein the summing step further comprises masking the unused channels in the second set of channels and summing the relocated first set of channels into the second set of received signals using the masked, unused channels in the second set of channels.

* * * * *